United States Patent [19]

Kovit et al.

[11] Patent Number: 4,759,256

[45] Date of Patent: Jul. 26, 1988

[54] TENSIONER RECOIL CONTROL APPARATUS

[75] Inventors: Sheldon L. Kovit; Bryan K. Yam, both of Houston, Tex.; Douglas W. J. Nayler, Mission Viejo, Calif.

[73] Assignee: NL Industries, Inc., New York, N.Y.

[21] Appl. No.: 866,781

[22] Filed: May 23, 1986

Related U.S. Application Data

[63] Continuation of Ser. No. 600,525, Apr. 16, 1984, abandoned.

[51] Int. Cl.[4] ..... F15B 13/04

[52] U.S. Cl. ..... 91/29; 91/31; 91/32; 91/33; 91/20; 254/277; 254/394; 254/392

[58] Field of Search ..... 91/20, 29, 31, 32, 33, 91/48, 364, 407, 449, 451, 452, 400; 254/277, 900, 392, 394

[56] References Cited

U.S. PATENT DOCUMENTS

| | | | |
|---|---|---|---|
| 3,067,761 | 3/1960 | Absalom | 137/599 |
| 3,309,065 | 3/1967 | Prud'homme et al. | 254/277 |
| 3,314,657 | 4/1967 | Prud'homme et al. | 254/392 |
| 3,714,995 | 2/1973 | Hanes et al. | 175/5 |
| 3,799,505 | 3/1974 | Duncan | 254/274 |
| 3,804,183 | 4/1974 | Duncan et al. | 175/5 |
| 3,824,896 | 7/1974 | Tull, III | 91/404 |
| 3,842,603 | 10/1974 | Ditzen | 60/416 |
| 3,865,066 | 2/1975 | White et al. | 114/230 |
| 3,871,622 | 3/1975 | Larralde et al. | 254/392 |
| 3,877,489 | 4/1975 | Louie et al. | 138/46 |
| 3,877,680 | 4/1975 | Childs et al. | 254/394 |
| 3,908,963 | 9/1975 | Bates et al. | 254/392 |
| 3,912,227 | 10/1975 | Meeker et al. | 254/277 |
| 4,072,122 | 2/1978 | Balston | 114/230 |
| 4,268,013 | 5/1981 | Khan | 254/392 |
| 4,351,261 | 9/1972 | Shanks | 114/264 |
| 4,501,219 | 2/1985 | Bates, Jr. | 254/392 |

FOREIGN PATENT DOCUMENTS 800900 5/1936 France .

*Primary Examiner*—Robert E. Garrett
*Assistant Examiner*—Thomas Denion
*Attorney, Agent, or Firm*—Browning, Bushman, Zamecki & Anderson

[57] ABSTRACT

Apparatus for controlling fluid communication with a fluid pressure system includes parallel flow paths connected to the system. A first flow path includes first valve apparatus for selectively closing the flow path. The second flow path includes relief valve apparatus responsive to fluid pressure in the second flow path to move from a closed configuration to an open configuration. Switching apparatus, including sensors for detecting the condition of the system, operate to close the first valve apparatus in response to pre-determined threshold values of such condition. Fluid communication from the system may thereafter occur along the second flow path at the relief valve apparatus opens in response to pressure buildup in the flow path. A third flow path, parallel to the first two flow paths, may be provided with throttling apparatus for controlled communication of fluid along such third flow path.

31 Claims, 3 Drawing Sheets

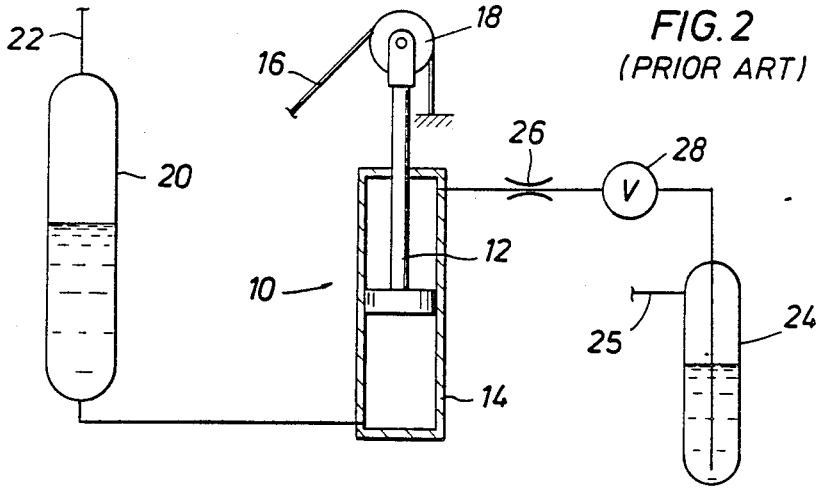
FIG. 2
(PRIOR ART)
FIG. 3
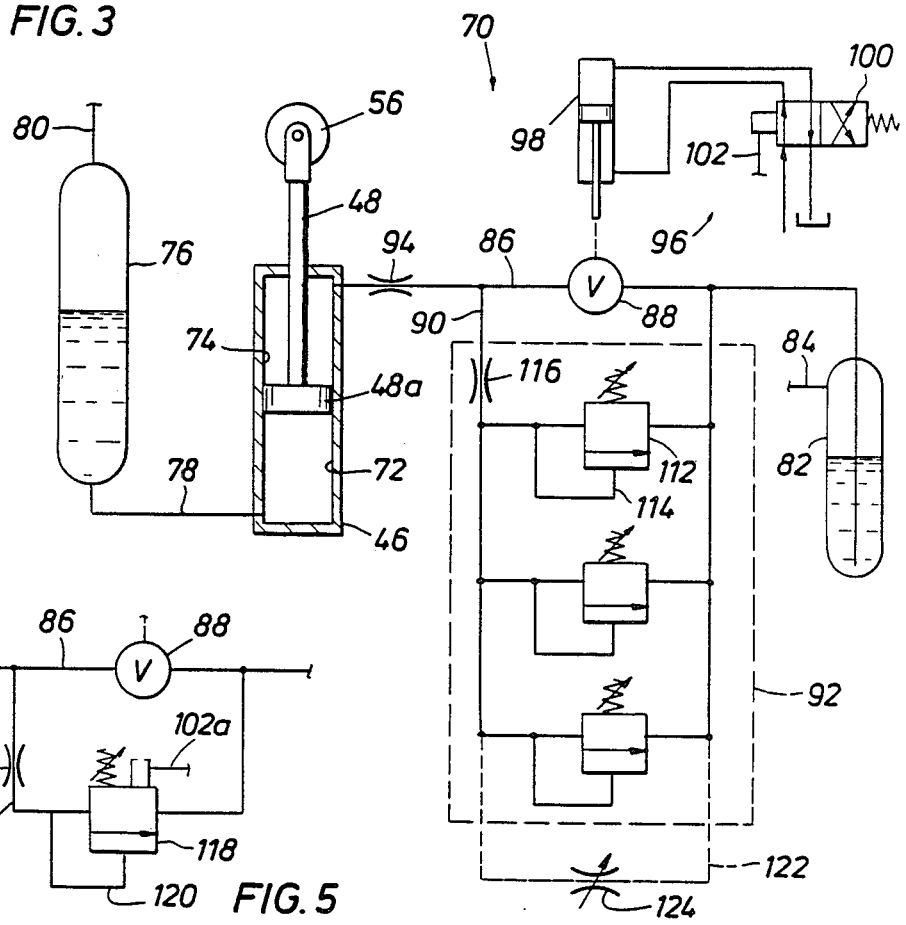
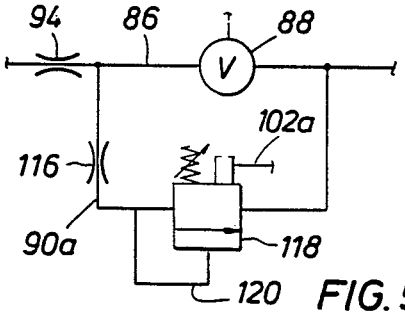
FIG. 5

TENSIONER RECOIL CONTROL APPARATUS

This is a continuation of application Ser. No. 600,525 filed Apr. 16, 1984, now abandoned.

BACKGROUND OF THE INVENTION

1. Field of the Invention

The present invention pertains to apparatus for controlling fluid flow relative to fluid pressure systems. More particularly, the present invention is related to apparatus for controlling fluid communication with a fluid pressure system in response to changing conditions relative to such system. The present invention finds particular application to a type of apparatus or system typically referred to as a "tensioner," and is well adapted to those tensioners which are used offshore in connection with marine riser pipe structures.

2. Description of the Prior Art

In connection with the drilling and production of offshore oil and gas wells, various operations are typically conducted from a support structure, such as a drill ship or semisubmersible platform, which rises and falls with the wave action. One or more wellheads are located on the floor of the body of water generally beneath such a structure. For each such wellhead, a package of equipment, for example a stack of blowout preventers, is run into place on a string of relatively large diameter pipe known as a riser pipe. After this running in operation, the riser pipe is left in place so that it extends upwardly from the wellhead area to a point above the surface of the water and near the support platform whereby it may serve as a rough guide for other strings of apparatus which must, from time to time, be lowered to the wellhead and/or into the well.

The riser pipe, which is anchored on its lower end at the wellhead structure, must be supported with respect to the platform or other support structure for several reasons, including the prevention of collapse of the riser pipe under its own weight as well as the prevention of excessive swaying motion of the riser pipe in the water. Accordingly, it is customary to support the riser pipe with respect to the platform by placing it under considerable tension, the magnitude of the tension load typically exceeding the weight of the riser pipe.

Maintaining the aforementioned tension load at a given value, or at least within a given range of values, is very difficult because of the heaving of the platform or other support structure due to wave action, for example. Thus, the tension cannot be applied by a static or fixed system. Tensioners are known for maintaining a tension load between riser pipe and a support structure in the presence of relative motion between the two.

A typical tensioner fluid pressure system is illustrated schematically in FIG. 2, and includes a tensioner shown in part generally at 10 comprising a piston 12 and cylinder 14 interconnected between the offshore platform and the riser pipe by means of a cable or other flexible line 16 seated in a sheave system 18 movable with the piston or cylinder. Thus, relative movements of the platform and riser pipe tend to cause corresponding relative reciprocation of the piston 12 and cylinder 14, and conversely, reciprocation of the piston and cylinder tend to cause, or at least permit, relative movement of the two interconnected offshore structures.

High pressure fluid communicated from a source 20 is applied against the piston 12 in one end of the cylinder 14, and it is the force of this pressurized fluid which ultimately supports the riser pipe with respect to the platform and applies the desired tension. The high pressure fluid, or at least a portion thereof, is compressible. More specifically, the body of high pressure fluid may be comprised entirely of a gas, or it may be a suitable liquid, such as oil, backed by a volume of pressurized gas communicated by means of a flow line 22 from a source of pressurized gas (not shown). Such application of high pressure fluid permits reciprocation of the piston 12 and cylinder 14, so as to accommodate relative movement of the platform and riser pipe, while still maintaining the tension load on the riser pipe within a given range of values. The application of such pressurized gas to the gas-liquid accumulator 20 also minimizes the effect of the position of the cylinder 14 on fluid pressure applied thereto, and thus to the tension load maintained by the piston and cylinder arrangement 10.

In order to prevent the piston 12 from slamming or jolting action when it reciprocates away from the high pressure end of the cylinder 14, a lower pressure balancing fluid from a source 24 is admitted into the opposite end of the cylinder. Such low pressure fluid may be liquid backed by pressurized gas communicated to the source 24 by a flow line 25 from a source of pressurized gas (not shown). The pressurized fluid may flow into and out of the cylinder 14 to permit the necessary reciprocations of the piston 12, but the low pressure fluid flow rate is controlled by a throttle 26 or the like which slows the piston speed, at least near the end of its stroke, so as to avoid undesirable slamming or jolting during normal operational reciprocations. The maintenance of low pressure fluid within the cylinder 14 also maintains the cylinder full for corrosion protection and lubrication. A manual shut-off valve 28 facilitates maintenance of the system.

A circumstance of concern in connection with the type of tensioner described above occurs when the riser pipe, or a portion thereof, is suddenly disconnected from the wellhead apparatus while the tensioners are still engaged. Such disconnections may occur due to accidents, for example the failure of the riser pipe itself or of some related wellhead apparatus, or through the operation of emergency disconnect systems which are used to disconnect the riser pipe, in the event of severe weather, for example. Such occurrences cannot be completely avoided, and it is not practicable to disengage the tensioners before disconnection of the riser pipe in every such instance. In tensioning the riser pipe, the system applies a large vertical upward force. If the riser pipe is disconnected, the tensioners will continue to apply this force, but the riser pipe, no longer anchored to the wellhead, will be raised upwardly toward the platform. The riser pipe will, in effect, be suddenly jerked upwardly at a relatively high rate of speed. The throttling apparatus 26 may suffice to cushion the advancing piston 12 toward the end of its stroke during normal operational reciprocation, but will not suffice to control the extremely high speeds and forces which prevail when the heavy and highly tensioned riser pipe is suddenly disconnected from the wellhead. The heavy riser pipe can gather sufficient momentum that the pipe will ultimately collide with the platform and may cause serious damage or injury. The particulars of such collision will vary depending upon the location of the support platform with respect to the wave crests and troughs at the time of disconnection of the riser pipe. However, it can be shown that disconnection, at whatever point, can result in a dangerous and expensive collision. As drilling continues at greater and greater depths, riser pipe structures become heavier, and the potential magnitude of such collisions increases.

It is desirable to provide a system for controlling the recoil of a riser in the event of an emergency disconnect of the riser from the underground structure, wherein the riser may be permitted to decelerate to a safe velocity generally toward the surface of the body of water by relieving the tension load on the riser. Such a system should also permit full stroke, normal reciprocation of the tensioner system. Further, such a system should preferably operate automatically, in response to the condition of the riser in the event of such a disconnect.

SUMMARY OF THE INVENTION

The present invention provides apparatus for controlling fluid communication with a fluid pressure system, such as a piston and cylinder system. First and second flow paths are connected to the system for fluid communication therewith, and may provide such fluid communication between the system and a source of relatively low pressurized fluid. First valve apparatus is included in the first flow path for selectively closing the flow path to prevent fluid communication therethrough. Second valve apparatus is included in the second flow path and is responsive to fluid pressure in the second flow path to move from a closed configuration to an open configuration for fluid communication therethrough along the second flow path.

Control, or switch, apparatus is provided for selectively closing the first valve apparatus depending on the condition of the fluid pressure system, which may include apparatus operatively connected to the fluid pressure apparatus, such as cable operatively connected to a piston and cylinder system of the fluid pressure system. The switching apparatus includes one or more sensing devices for detecting the condition of the system, directly or indirectly. Such sensing devices may, for example, detect the acceleration, speed or position of the piston of such a system relative to the corresponding cylinder, for example. Such sensors may, alternatively, detect the pressure of the fluid on either side of the piston head of such a system, for example. When the parameter to be sensed reaches a predetermined value or configuration, the switching apparatus may, by means of electronic signals, cause the first valve apparatus to close. Closure of the first valve apparatus prevents fluid communication along the first flow path, whereby fluid communication may be diverted to the second flow path, provided the second valve apparatus is in an open configuration. In the absence of an open configuration of the second valve apparatus, fluid pressure increases in the second flow path. When the pressure in the second flow path reaches a predetermined value, the second valve apparatus responds thereto by moving to an open configuration, thus permitting fluid communication along the second flow path. The first and second valve apparatus may be used in conjunction with throttling apparatus applied to one or both of the first and second flow paths. Also, a third flow path may be provided, generally parallel to the first and second flow paths, and include throttling apparatus through which fluid must pass to communicate along the third flow path.

The second valve apparatus may include two or more valves arranged in parallel, with each such valve responsive to fluid pressure in the second flow path to move to an open configuration for communication of fluid through the valve at a different predetermined pressure value. The second flow valve apparatus may include a multiple-setting valve, operable by means of the switching apparatus, for example, to configure the valve to respond to open at one or another of two or more values of fluid pressure in the second flow path.

In the particular embodiment illustrated, the present invention is provided in a form for application to, or including, apparatus for maintaining a load between two relatively movable objects, which may, for example, be a marine riser pipe and a support structure.

BRIEF DESCRIPTION OF THE DRAWINGS

FIG. 2 is a schematic illustration of a portion of a tensioner system as generally available;

FIG. 3 is a schematic illustration of a hydraulic circuit of a tensioner system according to the present invention;

FIG. 5 is a fragmentary schematic illustration indicating another version of a hydraulic circuit of a tensioner system according to the present invention.

DESCRIPTION OF PREFERRED EMBODIMENTS

Figure 1:
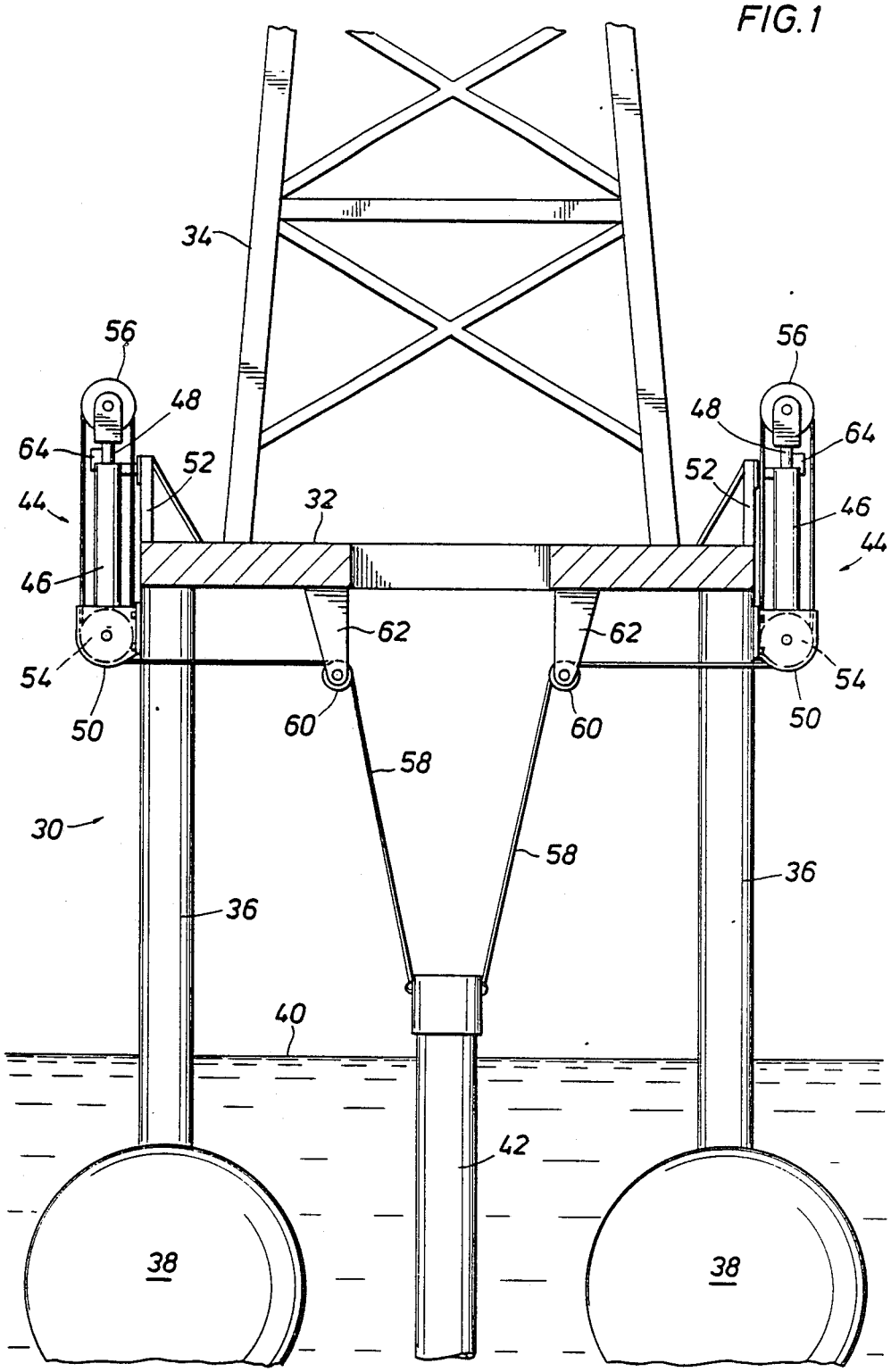
FIG. 1 is a fragmentary, partly schematic, elevation in partial section of a marine drilling platform, illustrating the use of tensioners according to the present invention to support riser pipe.

An offshore support structure is shown generally and schematically at 30 in FIG. 1 in the form of a semi-submersible type platform. The platform structure 30 includes a deck 32 supporting a derrick 34. The deck 32 is carried on vertical legs 36 which in turn rest upon buoyant pontoon structures 38. Although the pontoon structures 38 are designed to extend below the upper surface of the body of water 40, and although the platform 30 would also be moored or anchored, the platform will, nevertheless, undergo a certain amount of vertical heaving and falling motion in the water. The upper portion of a marine riser pipe structure 42 is shown extending upwardly to a point above the surface of the body of water 40, but below the deck 32 of the support platform 30. It will be understood that, in accord with principals well known in the art, the riser pipe structure 42 will be affixed to wellhead apparatus (not shown) at the floor of the body of water 40.

FIG. 1 also illustrates a pair of riser tensioners shown generally at 44, mounted on the platform 30 for supporting and tensioning the riser pipe 42. For simplicity, only two tensioners 44 are illustrated, but it will be understood that as many tensioners as necessary or desired can be employed, and that they will normally be symmetrically distributed about the riser pipe 42.

Each of the tensioners comprises a pair of relatively reciprocable tensioner bodies in the form of a cylinder 46 and a piston 48, respectively. A base block 50 is affixed to the lower end of each cylinder 46 as well as to one of the legs 36 of the platform 30. The upper end of each cylinder 46 is affixed to the deck 32 by a bracket structure 52. Thus, each cylinder 46 is fixedly mounted on the platform 30. The block 50 rotatably mounts a pulley assembly 54. The piston rod of each piston 48 projects from the upper end of the corresponding cylinder 46 and carries a second pulley assembly 56. Each of the tensioners 44 has associated therewith a respective cable 58, one end of which is attached to the top of the riser pipe structure 42. Each cable 58 extends upwardly and is reaved over a respective pulley 60 carried by a bracket 62 mounted on the deck 32. From its respective pulley 60, each cable 58 extends to a respective one of the tensioners 44 and is reaved over the pulleys 54 and 56 as many times as necessary to provide a desired ratio between the stroke of the piston 48 and the relative movement of the structures 30 and 42. Finally, the other end of each cable 58 is affixed to the platform 30.

Each of the tensioners may be fitted with a sensing device 64, shown schematically as being mounted on one or the other of the corresponding cylinder 46 or piston 48 while maintaining functional contact with the other of such members. The operation and purpose of such sensors 64 are discussed in further detail hereinafter.

It can thus be seen that the cylinders 46 and pistons 48 are functionally interconnected with the platform 30 and riser pipe 42, respectively, so that relative movements between the platform and the riser pipe will tend to cause corresponding reciprocation of the cylinders and pistons. More specifically, each cylinder 46 is fixed with respect to the platform 30, and will move therewith. Each piston 48, for reasons to be developed more fully below, is in a supportive relation with respect to the riser pipe 42, and will move therewith. For convenience, reference may be made to movement of a piston 48 or a cylinder 46. It should be understood that, unless otherwise indicated, movement of either of such two bodies will mean movement relative to the other of the two bodies. More specifically, unless otherwise indicated, upward movement of a piston 48 will refer to both actual upper movement of the piston and/or downward movement of the corresponding cylinder 46, and all such relative movements will be referred to as movements or reciprocations in a "first directional mode." Likewise, downward movement of a piston 48 will, unless otherwise indicated, also refer to upward movement of the corresponding cylinder 46, that is, will include any and all movements in a "second directional mode" opposite to the first directional mode.

Hydraulic circuitry of a tensioner system according to the present invention is shown generally at 70 in FIG. 3, including a tensioner piston 48 and cylinder 46. The piston head 48*a* of the piston 48 divides the cylinder 46 into two variable volume chambers 72 and 74. The lower chamber 72, at the closed end of the cylinder 46, communicates with an accumulator 76 for high pressure fluid by means of a conduit 78. To make the high pressure fluid at least partly compressible, the body of high pressure fluid may be entirely pressurized gas, or may include a suitable liquid, such as oil, backed by a volume of pressurized gas, the latter provided by a compressor or the like (not shown) connected to the accumulator 76 by a conduit 80. The lower cylinder chamber 72 thus serves as a force application chamber whereby the high pressure fluid exerts a lifting action on the piston 48, that is, tends to reciprocate the piston and the cylinder 46 in the first directional mode. This force acts against the weight of the riser pipe 42 pulling downwardly on the piston 48 through the pulley assembly 56 carried by the piston rod. The pressure in the accumulator 76 and in the cylinder chamber 72 is adjusted to impart a given lifting load on the riser pipe structure 42, which load exceeds the mere weight of the riser pipe structure, and places that structure in considerable tension.

As noted, the high pressure fluid in the accumulator 76 and the cylinder chamber 72 may consist entirely of compressed gas, or, as shown, may include a volume of oil filling the chamber 72 and the lower portion of the accumulator, and backed by a compressed gas in the upper portion of the accumulator. In either case, should the support platform 30 heave upwardly, the cylinder 46 may reciprocate upwardly with respect to the piston 48 by virtue of further compression of the gas in the accumulator 76 and egress of fluid from the lower cylinder chamber 72 through the conduit 78 into the accumulator. When the platform 30 moves downwardly, the pressure of the gas in the accumulator 76 will force fluid back into the then-expanding lower cylinder chamber 72 to maintain a suitable lifting force on the piston 48. Thus, while accommodating the relative movement of the structures 30 and 42, the tensioner maintains the load on the structure 42 generally at a given level, or within a given range of values.

When the piston 48 and the cylinder 46 reciprocate in the aforementioned first directional mode, the piston could slam or jolt toward the end of its stroke were it not balanced or dampened. For this purpose, the upper cylinder chamber 74 communicates with an accumulator bottle 82 containing fluid which is pressurized, but to a much lower value than the fluid in the high pressure accumulator 76. The low pressure fluid may be pressurized gas, or may be liquid backed by pressurized gas communicated to the accumulator 82 by a flow line 84 from a source of pressurized gas (not shown). The fluid pressure from the accumulator 82 need only be sufficient to cause the fluid to flow into the cylinder chamber 74 when that chamber is expanding. When the upper cylinder chamber 74 is contracting, that is, when the piston 48 and cylinder 46 are reciprocating in the first directional mode, fluid may flow from the cylinder chamber 74 to the low pressure accumulator 82 by means described hereinafter. The upper cylinder chamber 74 thus serves as a balancing chamber.

As indicated in FIG. 3, the two accumulators 76 and 82 each contain a volume of liquid such as oil pressurized by a volume of gas in the upper portion of the respective accumulator. The cylinder chambers 72 and 74 take suction from the lower ends of their respective accumulators 76 and 82, so that the oil is used to fill the chambers of the cylinder 46 and is maintained pressurized by the volumes of compressed gas provided at the accumulators.

The present invention contemplates at least two flow paths connecting the balance chamber 74 with the low pressure accumulator 82. A first flow path 86 includes a first valve 88 which may be maintained normally open for fluid communication between the balance chamber 74 and the accumulator 82. A second flow path 90 is provided generally parallel to the first flow path 86 with its valve 88, and also connects the balance chamber 74 with the accumulator 82 for fluid communication therebetween. The second flow path 90 includes apparatus for controlling the flow of fluid along the second flow path indicated generally by the dashed line box 92 and discussed more fully hereinafter. Generally, the second flow path 90 is normally closed by such apparatus while fluid is able to flow along the first flow path 86.

A throttling device, such as an orifice 94, may be provided to define a minimum flow area cross section for all of the flow paths between the balance chamber 74 and the accumulator 82. It will be appreciated that the part of the fluid flow path or paths between the balance chamber 74 and the accumulator 82 defining the smallest effective flow area will in effect serve as a throttling apparatus. Such a throttling device could be the outlet port of the balance chamber 74, an orifice plate mounted near the cylinder 46, an outlet conduit or a throttling valve. Consequently, a throttling device such as the orifice 94 is generally optional. In any case, the flow area defined by whatever throttling apparatus is present is intended to restrict the rate of flow of fluid between the balance chamber 74 and the accumulator 82 to cushion the reciprocation of the piston 48 and cylinder 46 in the aforementioned first directional mode without closing the flow paths to such flow.

Figure 4:
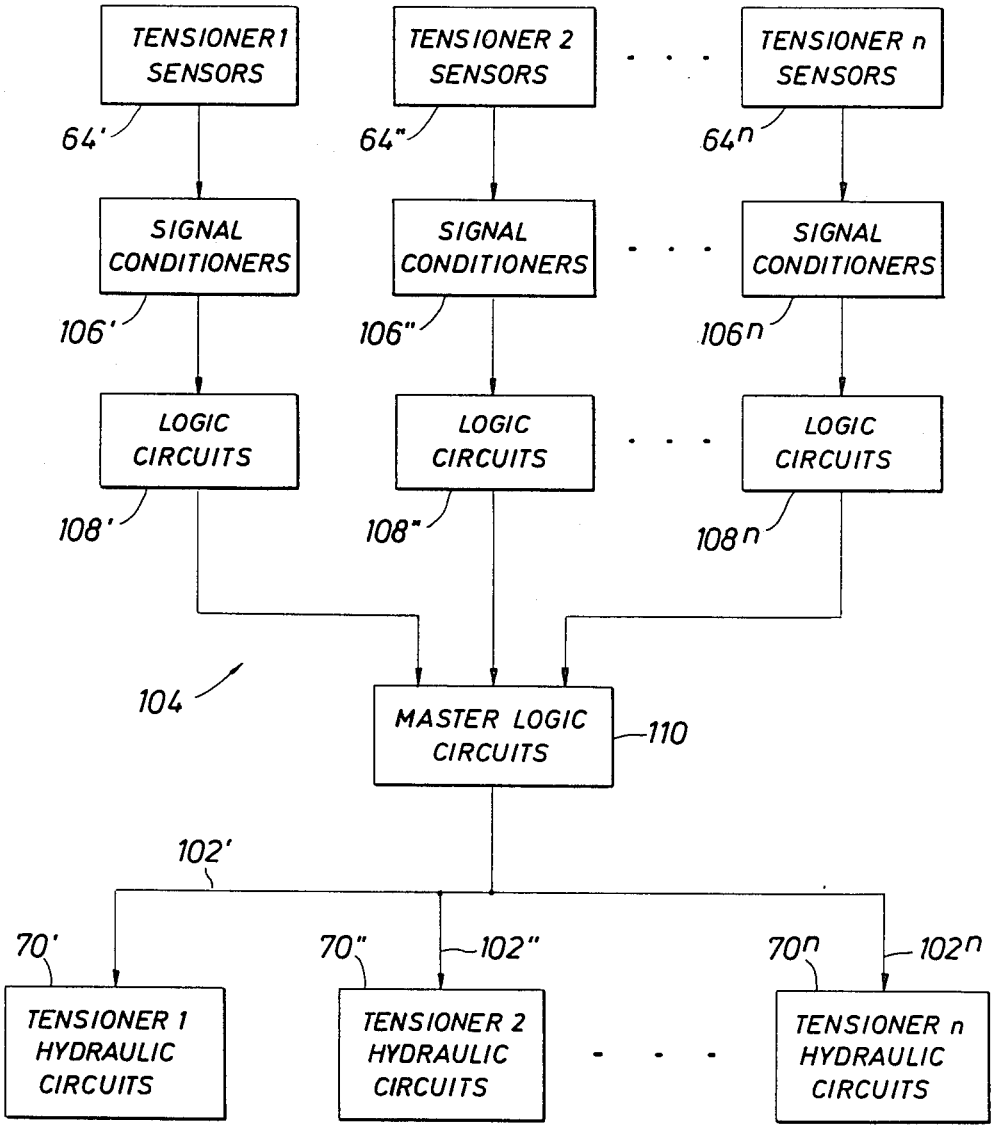
FIG. 4 is a schematic illustration of an electrical circuit of a tensioner system according to the present invention.

The first valve 88 is hydraulically or pneumatically operated in response to conditions of the tensioner 44. A pilot control system for operating the first valve 88 is shown schematically in FIG. 3 generally at 96. The pilot control system 96 includes a fluid pressure (pneumatic or hydraulic) piston-and-cylinder assembly 98 linked to the first valve 88 and operable to selectively move the first valve between a first, open configuration, in which fluid flow is permitted along the first flow path 86, and a second closed configuration in which the first valve 88 closes the first flow path against fluid flow therethrough. The piston-and-cylinder assembly 98 is in turn operated by a solenoid valve 100 provided with an appropriate fluid source and a reservoir, and controlled by means of appropriate electrical signals received by means of electrical lead lines 102. The electrical signals so received are provided by a switching system which generates the signals in response to the condition of one or more tensioners on the platform 30. FIG. 4 illustrates one form of a switching system 104 which may be used to provide such electrical signals for operation of the pilot control systems 96 of the tensioner hydraulic circuits 70.

As illustrated in FIG. 4, the switching system 104 is applicable for use with multiple tensioners to be operated by hydraulic circuitry such as 70 in FIG. 3. For purposes of illustration and discussion, the switching system 104 is thus presented as constructed for use with an indefinite number n of tensioners being so operated, with each such tensioner being equipped with a sensor 64 (FIG. 1). Where separate components of the switching system 104 are provided for the respective tensioners, like number designations are distinguished by primes through n. Additional tensioners may be included in the apparatus supporting the riser pipe 42, with hydraulic circuitry 70 operated by the switching circuitry 104, but lacking sensors. The number of tensioners equipped with sensors may be determined, at least in part, by the needs of the application of the invention.

Each sensor 64 is positioned on or in conjunction with a corresponding tensioner 44. The location of a particular sensor 64 as illustrated in FIG. 1 may be taken as symbolic, since the nature of the sensor will dictate the possible mounting configurations available. For example, a sensor may be utilized which measures the fluid pressure in either chambers 72 or 74 of the tensioner cylinder 46. This pressure may be expected to vary, at least initially, in response to a sudden release of the riser pipe 42 with subsequent rapid motion of the pipe upwardly toward the platform 30. In such case, the sensor 64 would be appropriately incorporated in the wall of the cylinder 46, for example, or in the flow line between the cylinder chamber 74 and the orifice 94, or in the conduit 78, for example. A sensor may instead be utilized to detect the speed of movement of the piston 48 relative to the cylinder 46. In such case, the sensor may be positioned as illustrated in FIG. 1, at the top of the cylinder 46 and in operational contact with the piston 48. A sensor designed to measure the acceleration of the piston 48 relative to the cylinder 46 may be positioned at that location as illustrated in FIG. 1 as well. A sensor which detects the position of the piston 48 relative to the cylinder 46 may also be positioned at the top of the cylinder, for example. Position, speed and acceleration sensors may also be located to contact the cable 58, for example, to sense the condition of the cable as reflective of the condition of the corresponding tensioner and that of the riser pipe 42. In general, the present invention may utilize a switch system such as 104 which may operate the fluid pressure controls, such as the first valve 88, in response to conditions of a fluid pressure system, such as the tensioner system which may include the cable 58 and the like. It will be appreciated that all of the aforementioned sensor types are known in the art, and need not be further described in detail herein.

In any case, the sensor 64 will generate an electrical signal depending on the condition of the tensioner system which is being detected by the sensor. For example, a velocity sensor may emit an electronic signal whose amplitude depends on the velocity of the piston 48 relative to the cylinder 46. In each case, a tensioner output signal is fed to a signal conditioner 106 of the switching system 104. Each of the signal conditioners 106'–106$^n$ operates on the data signal received from the corresponding sensor 64'–64$^n$ to place the signal in condition for presentation to a subsequent logic circuit 108'–108$^n$. For example, depending upon the requirements of the logic circuits 108'–108$^n$ and the nature of the sensor output signals, the signal conditioners 106'–106$^n$ may filter extraneous noise and/or unusable frequency values from the output signals, and possibly convert the output signals from analog to digital form. Thus, the signals produced by the signal conditioners 106'–106$^n$ and received by the logic circuits 108'–108$^n$ reflect the conditions at the respective tensioners 44, but are in forms which may be readily measured, or detected by the logic circuits. Consequently, pre-determined physical conditions at the tensioners 44, such as a speed or acceleration value for a piston 48 beyond pre-chosen values coincident with an emergency situation, may be detected by the corresponding logic circuit 108 as a voltage signal whose value exceeds a value corresponding to the pre-chosen threshold speed or acceleration value for the piston which indicates the disconnection of the riser pipe 42 and its rapid movement upwardly toward the platform 30. Thus, each logic circuit 108 may produce an output signal depending on the condition of the signal input to the logic circuit compared to preset parameters within the logic circuit, such as preset voltage values, wherein the output signal from the logic circuit reflects whether the input signal to the logic circuit has exceeded the pre-determined threshold conditions.

The outputs from the logic circuits 108'–n are received by the master logic circuits 110, where the signals may be further interpreted. For example, the master logic circuits 110 may produce output signals depending on the number of input signals to the master logic circuits which reflect emergency conditions at the tensioners 44. If one tensioner 44 displays a piston 48 moving too rapidly, but the remaining tensioners do not, the master logic circuits 110 may interpret the electronic signals reflecting such conditions as an anomaly, for example, not caused by a release of the riser pipe 42 from the seabed. If two or more tensioners reflect too great a piston speed, for example, the master logic circuits 110 may determine that the riser pipe 42 has indeed broken free and is headed rapidly toward the platform 30. It will be appreciated that such threshold requirements for determining an emergency may be chosen depending on the particular application of the present invention. In any case, if the master logic circuits 110 determine, based on the electronic signals input thereto, that the riser pipe 42 has broken free and is moving too rapidly upwardly toward the platform 30, the master logic circuits will generate the triggering signals output over the electrical leads 102'-102$^n$ to all of the tensioner hydraulic circuits 70'-70$^n$, as generally illustrated in FIG. 3. Where additional tensioners are utilized without sensors, the corresponding additional tensioner hydraulic circuits will also receive the triggering signals to respond to the emergency. Since all of the hydraulic circuits 70 may be structurally and functionally alike, for example, the operation of these circuits in response to an emergency may be considered by discussing one such system, it being appreciated that all tensioner systems will respond to the triggering signals from the master logic circuits 110.

In the event an emergency triggering signal is received from the master logic circuits 110 at the tensioner hydraulic circuit 70 (FIG. 3) over the electrical lead lines 102, the solenoid valve 100 will be shifted to operate the piston-and-cylinder cylinder assembly 98 to close the first valve 88, shutting off the first flow path 86 to fluid communication therethrough. This situation will prevail until the switch system 104 receives an appropriate electrical output signal from its sensor 64 indicating that the emergency situation has ceased (the riser pipe 42 has slowed in its ascent, for example), whereupon the switch system master logic circuits 110 may signal the solenoid valve 100 to reopen the first valve 88 for fluid flow along the first flow path 86. Alternatively, the first valve 88 may stay closed, to be reopened by an operator, for example, as a fail-safe precaution.

With the first flow path 86 closed off against fluid communication therethrough by the closure of the first valve 88, fluid being driven from the balance chamber 74 may be passed to the accumulator 82 by means of the second flow path 90, for example, under the control of the relief valve system 92. The second flow path 90 may include one or more relief valves 112 (three are shown for purposes of illustration and discussion rather than limitation), arranged generally parallel to the first flow path 86, and specifically the first valve 88. Each of the relief valves 112 features a tap 114 of the second flow path 90 whereby the relief valve may be responsive to pressure in the flow line, between the relief valve and the balance chamber 74 as illustrated. Each such relief valve 112 may be adjusted to move from a normally closed configuration to an open configuration in response to fluid pressure in the second flow path 90 reaching a pre-determined value. When such value is reached and the corresponding relief valve 112 is thereby opened, fluid may flow along the second flow path 90 between the balance chamber 74 and the low pressure accumulator 82. With more than one such relief valve 112 present in the second flow path 90, the various relief valves may be set to so open at different fluid pressure values in the second flow path to respond to the piston 48 and, therefore, the riser pipe 42, moving at a certain speed or acceleration, etc. Thus, multiple relief valves 112 in parallel in the second flow path allow for greater flow along the path than would be permitted if only one such relief valve were present.

In particular, with multiple relief valves 112 in parallel, set to open at different conditions of the tensioner system, different numbers of the valves will be open under different tensioner system conditions to respond to such differing conditions. When the pressure in the second flow path 90 falls below the threshold (opening) pressure of a given relief valve 112, that valve will close. Ultimately, as the riser pipe 42 is brought under control, that is, its velocity toward the surface is sufficiently reduced by the riser's own weight, all the relief valves may close to close the second flow path 90.

A throttling device, such as an orifice 116, may also be placed in the second flow line so that the fluid pressure presented to the relief valves 112 may be maintained lower in the presence of even larger fluid flow along the second flow path.

Another version of a relief valve 118 of the system 92 is illustrated in FIG. 5 in the second flow path **90*a*. Such a relief valve 118 has a sensor tap 120 for responding to the fluid pressure in the second flow path 90*a*. However, the relief valve 118 has multiple settings which may be adjusted mechanically, but which may be selected electronically in response to appropriate signals from the switch system 104 received by means of electrical lead lines 102*a* from the master logic circuits 110. For example, such a multiple setting relief valve 118 may be adjusted to open in response to two different pressure levels in the second flow path 90*a*. When conditions warrant, for example if the fluid pressure along the second flow path 90*a* continues to rise with the valve 118 open at a first setting, an electrical signal, based on a sensor 64 noting conditions at a tensioner 44, may shift the relief valve 118** to its other open setting to provide a larger flow path through the valve along the second flow line, for example.

As another option, a third flow path 122 may be provided generally parallel to the first flow path 86 and the second flow path 90 (or **90*a*), with the third flow path equipped with a flow control valve or throttling device such as the variable orifice 124. In the absence of such a third flow path with controlled flow cross section, the fluid flow along the second flow path might cease due to pressure conditions, with the riser pipe 42 no longer moving too rapidly toward the platform 30, for example, without the piston 48 having completed its full stroke and the relief valve system 92 closing the second flow path. In such case, if the first valve 88 is opened, the piston 48 may again rapidly approach the end of the cylinder 46 with accompanying rapid movement of the riser pipe 42. By providing a third flow path 122 with variable cross section throttling apparatus 124, the piston 48 may be permitted to complete its stroke with the first valve 88 closed, for example. At the completion of the piston stroke, if the first valve 88 is opened, the tensioner 44 has no further capability for expansion, that is, the force chamber 72 has completed its expansion and can no longer drive the riser pipe 42** upwardly at too rapid a rate.

The present invention provides a fluid flow control system applicable to control the recoil of tensioner apparatus, for example. As an illustration, in the environment described herein, the first flow valve 88 in each tensioner hydraulic circuit 70 will normally be open to permit fluid communication between tensioner cylinder 46 and the low pressure accumulator 82 by way of the first flow path 86. In the event of an emergency disconnect of the riser pipe 42, or a portion thereof, the electrical switching circuit 104 will actuate the solenoid valve 100 of each hyraulic circuit 70 to close the first valve 88 in response to the switching circuit 104 acting on sensor signals disclosing the emergency. The emergency situation is detected by the sensor 64 acting at any part of the tensioner system, whether at the piston 48 and cylinder 46, the riser 42, or the cable 58, for example, the "system" including all such components. Closing of the first valve 88 causes fluid from the balance chamber 74 of the tensioner cylinder 46 to pass through the orifice 116 along the second flow path 90 (90*a*) to the relief valve(s). The relief valve(s) will not open until a threshold pressure in the second flow path has been reached. The resulting pressure increase in the balance chamber 74 will slow the rise of the piston 48, allowing the tension in the cables 58 to decrease whereby the weight, or a portion thereof, of the riser pipe will decelerate the riser pipe to match the motion of the platform 30. Once the riser pipe velocity matches that of the support platform 30, flow through the relief valve(s) ceases with the pressure in the balance chamber 74 decayed to a value which, in conjunction with the riser weight and inertial forces, will balance the pressure in the force chamber 72 to hold the riser stationery with respect to the support platform.

Although the present invention has been illustrated and described herein in the environment of a tensioner apparatus for use with offshore vessels and the like, it will be appreciated that the present invention may find a wide variety of applications. The present invention is useful in interconnecting moving bodies in general, wherein, for example, relative movement between the so interconnected bodies is to be accommodated to maintain relatively constant tension, for example.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. Apparatus for controlling fluid communication with a fluid pressure system, comprising:

a. a first flow path connected to said system whereby fluid may be communicated with said system;

b. first normally open valve means included in said first flow path for selectively closing said flow path to prevent such fluid communication along said flow path;

c. a second flow path connected to said system for fluid communication with said system; and d. second normally closed valve means included in said second flow path and responsive to fluid pressure in said second flow path to move from a first configuration, in which said second valve means is closed to fluid communication therethrough, to a second configuration in which said second valve means is open to fluid communication therethrough along said second flow path;

e. whereby fluid may communicate with said system along said first flow path when said first valve means is open, and, whereby said first valve means may be closed, and after pressure in said second flow path has increased to move said second valve means to said second configuration, fluid may communicate with said system along said second flow path.

2. Apparatus as defined in claim 1 further comprising switch means for selectively operating said first normally open valve means according to the condition of said system, and including sensor means for detecting such condition of said system.

3. Apparatus as defined in claim 2 wherein said sensor means produces electrical signals for operating said switch means depending on the acceleration of said system.

4. Apparatus as defined in claim 2 wherein said sensor means produces electrical signals for operating said switch means depending on the speed of said system.

5. Apparatus as defined in claim 2 wherein said sensor means produces electrical signals for operating said switch means depending on the configuration of said system.

6. Apparatus as defined in claim 2 wherein said sensor means produces electrical signals for operating said switch means depending on fluid pressure in said system.

7. Apparatus as defined in claim 2 wherein said second normally closed valve means may assume at least two open configurations allowing fluid communication therethrough along said second flow path responsive to fluid pressure in said second normally closed flow path, and said second valve means is operable by means of said switch means for selection of such configuration in response to said fluid pressure.

8. Apparatus as defined in claim 1 further comprising throttling means through which fluid may communicate between said system and at least one of said first and second flow paths and defining a minimum flow area cross section for communication of fluid therethrough.

9. Apparatus as defined in claim 1 further comprising:

a. a third flow path connected to said system for fluid communication with said system; and b. throttling means, included in said third flow path and defining a minimum flow area cross section for communication of fluid therethrough and along said third flow path.

10. Apparatus as defined in claim 9 wherein said first, second and third flow paths are generally mutually parallel.

11. Apparatus as defined in claim 1 wherein said first and second flow paths are generally mutually parallel.

12. Apparatus as defined in claim 1 wherein said second normally closed valve means further comprises at least two normally closed valves generally in parallel along said second flow path, each such valve being responsive to fluid pressure in said second flow path to move from a closed first configuration to an open second configuration for fluid communication therethrough along said second flow path.

13. Fluid pressure apparatus comprising:

a. a cylinder;

b. a piston dividing said cylinder into two variable volume chambers, one of said chambers communicating with a source of relatively high pressure fluid tending to reciprocate said piston and cylinder in a first directional mode whereby said one chamber may serve as a force application chamber, and the other of said chambers communicating with a source of relatively low pressure fluid for resisting relative reciprocation of said piston and cylinder in said first directional mode whereby said other chamber may serve as a balancing chamber, said balancing chamber having outlet means for egress of pressurized fluid from said balancing chamber to permit relative reciprocation of said piston and cylinder in said first directional mode;

c. first and second generally parallel flow paths connecting said outlet means with said source of relatively low pressure fluid for such communication therebetween along either of said flow paths;

d. first normally open valve means included along said first flow path for selectively closing said flow path against fluid communication therethrough;

e. second normally closed valve means included in said second flow path and responsive to fluid pressure along said second flow path between said outlet means and said second valve means, whereby said second valve means may move from a closed configuration to an open configuration for fluid communication therethrough in response to fluid pressure in said second flow path; and f. switch means for selectively closing said first valve means depending on the condition of said piston relative to said cylinder, and including sensor means for detecting said condition.

14. Apparatus as defined in claim 13 further comprising throttling means through which fluid may communicate between said outlet means and at least one of said first and second flow paths and defining a minimum flow area cross section for communication of fluid therethrough.

15. Apparatus as defined in claim 13 wherein said second valve means may assume at least two open configurations allowing fluid communication therethrough along said second flow path responsive to fluid pressure in said second flow path, and said second normally closed valve means is operable by means of said switch means for selection of such configuration in response to said fluid pressure.

16. Apparatus as defined in claim 13 wherein said condition sensed by said sensor means to operate said switch means comprises the acceleration of said piston relative to said cylinder.

17. Apparatus as defined in claim 13 wherein said condition sensed by said sensor means to operate said switch means comprises the speed of said piston relative to said cylinder.

18. Apparatus as defined in claim 13 wherein said condition sensed by said sensor means to operate said switch means comprises the position of said piston relative to said cylinder.

19. Apparatus as defined in claim 13 wherein said condition sensed by said sensor means to operate said switch means comprises the fluid pressure communicating out of said outlet.

20. Apparatus as defined in claim 13 further comprising:

a. a third flow path connecting said outlet means with said source of relatively low pressure fluid generally parallel to said first and second flow paths for communication therebetween along any of said flow paths; and b. throttling means included in said third flow path and defining a minimum flow area cross section for communication of fluid therethrough and along said third flow path.

21. Apparatus as defined in claim 13 wherein said second normally closed valve means further comprises at least two normally closed valves generally in parallel along said second flow path, each such valve being responsive to fluid pressure in said second flow path to move from a closed configuration to an open configuration for fluid communication therethrough along said second flow path.

22. Tensioner apparatus for maintaining a load between first and second relatively movable objects comprising:

a. first and second tensioner bodies mounted for relative reciprocable movement, said first and second tensioner bodies further being functionally interconnected with said first and second objects, respectively, whereby relative movement of said objects tends to cause corresponding relative reciprocation of said tensioner bodies;

b. means associated with said tensioner bodies for applying a force between said bodies tending to reciprocate said bodies in a first directional mode and thereby supporting said second object with respect to said first object;

c. means defining a balancing chamber cooperative between said tensioner bodies and communicating with a source of pressurized fluid for resisting reciprocation of said bodies in said first directional mode, said balancing chamber having outlet means communicating therewith for egress of pressurized fluid from said balancing chamber so as to permit reciprocation of said tensioner bodies in said first directional mode;

d. first and second generally parallel flow paths connecting said outlet means with said source of pressurized fluid for such communication therebetween along either of said flow paths;

e. first normally open valve means included along said first flow path for selectively closing said flow path against fluid communication therethrough; and f. second normally closed valve means included in said second flow path and responsive to fluid pressure along said second flow path between said outlet means and said second normally closed valve means, whereby said second normally closed valve means may be moved from a closed configuration to an open configuration for fluid communication therethrough in response to fluid pressure in said second flow path.

23. Apparatus as defined in claim 22 further comprising throttling means through which fluid may communicate between said outlet means and at least one of said first and second flow paths and defining a minimum flow area cross section for communication of fluid therethrough.

24. Apparatus as defined in claim 22 further comprising switch means for selectively closing said first normally open valve means depending on the relative condition of said first and second tensioner bodies, and including sensor means for detecting said condition.

25. Apparatus as defined in claim 24 wherein said second normally closed valve means may assume at least two open configurations allowing fluid communication therethrough along said second normally closed flow path responsive to fluid pressure in said second flow path, and said second valve means is operable by means of said switch means for selection of such configuration in response to said fluid pressure.

26. Apparatus as defined in claim 24 wherein said condition sensed by said sensor means to operate said switch means comprises the relative acceleration between said first and second tensioner bodies.

27. Apparatus as defined in claim 24 wherein said condition sensed by said sensor means to operate said switch means comprises the relative speed between said first and second tensioner bodies.

28. Apparatus as defined in claim 24 wherein said condition sensed by said sensor means to operate said switch means comprises the position of one said tensioner body relative to the other said tensioner body.

29. Apparatus as defined in claim 24 wherein the condition so sensed by said sensor means to operate said switch comprises fluid pressure communicating out of said outlet means chamber.

30. Apparatus as defined in claim 22 further comprising:

a. a third flow path connecting said outlet means with said source of pressurized fluid generally parallel to said first and second flow paths for communication therebetween along any of said flow paths; and b. throttling means included in said third flow path and defining a minimum flow area cross section for communication of fluid therethrough and along said third flow path.

31. Apparatus as defined in claim 22 wherein said second normally closed valve means further comprises at least two valves generally parallel along said second normally closed flow path, each such valve being responsive to fluid pressure in said second flow path to move from a closed configuration to an open configuration for fluid communication therethrough along said second flow path.

* * * * *

UNITED STATES PATENT AND TRADEMARK OFFICE

CERTIFICATE OF CORRECTION

PATENT NO. : 4,759,256

DATED : July 26, 1988

INVENTOR(S) : Sheldon L. Kovit et al

It is certified that error appears in the above-identified patent and that said Letters Patent is hereby corrected as shown below:

In Column 12, line 30, delete "normally closed"; and line 31, after "second" insert --normally closed--.

In Column 13, line 34, after "second" insert --normally closed--; and in line 56, after "outlet" insert --means--.

In Column 14, line 64, delete "normally closed"; and line 66, after "second" insert --normally closed--.

In Column 15, line 16, delete "chamber".

In Column 16, line 13, after "two" insert --normally closed--; and line 14, delete "normally closed".

Signed and Sealed this

Thirty-first Day of January, 1989

*Attest:*

*Attesting Officer*

DONALD J. QUIGG

*Commissioner of Patents and Trademarks*